US005518113A

United States Patent [19]

Boone

[11] Patent Number: 5,518,113

[45] Date of Patent: May 21, 1996

[54] GOLF CLUB BAG WITH CLUB DIVIDER

[75] Inventor: David D. Boone, El Toro, Calif.

[73] Assignee: Lynx Golf, Inc., City of Industry, Calif.

[21] Appl. No.: 258,722

[22] Filed: Jun. 13, 1994

[51] Int. Cl.[6] ..... A63B 55/00

[52] U.S. Cl. ..... 206/315.6; 206/315.3

[58] Field of Search ..... 206/315.3–315.8, 206/315.2; 280/DIG. 6; 211/70.2; 248/96

[56] References Cited

U.S. PATENT DOCUMENTS

| | | | |
|---|---|---|---|
| 2,114,870 | 4/1938 | Calkins | 206/315.6 |
| 2,128,546 | 8/1938 | Venmore | 206/315.6 X |
| 2,364,223 | 12/1944 | Keim | 206/315.3 |
| 2,602,676 | 7/1952 | Fieldhouse | 280/DIG. 6 X |
| 2,607,382 | 8/1952 | Le Vine | 206/315.6 |
| 2,781,072 | 2/1957 | Kouke | 206/315.6 X |
| 4,130,153 | 12/1978 | Zopf | 206/315.6 |
| 4,332,283 | 6/1982 | Rader | 206/315.6 |
| 4,340,102 | 7/1982 | Isabel | 206/315.6 |
| 4,779,725 | 10/1988 | Gerber | 206/315.6 X |
| 4,844,253 | 7/1989 | Reimers | 206/315.6 |
| 4,858,761 | 8/1989 | Fumia | 206/315.6 X |
| 5,071,147 | 12/1991 | Stansbury | 206/315.6 X |
| 5,094,345 | 3/1992 | Yonnetti | 206/315.6 X |
| 5,102,529 | 4/1992 | Hickin | 206/315.6 X |
| 5,103,974 | 4/1992 | Antonious | 206/315.6 |
| 5,125,507 | 6/1992 | Graziano, Jr. | 206/315.6 |

FOREIGN PATENT DOCUMENTS

| | | | |
|---|---|---|---|
| 527306 | 10/1940 | United Kingdom | 206/315.3 |

*Primary Examiner*—Sue A. Weaver

*Attorney, Agent, or Firm*—Leonard Tachner; Flam & Flam

[57] ABSTRACT

An improved golf club bag has a divider top that is adapted to receive golf clubs in a manner which properly distributes the golf clubs within the bag to balance the distribution of the weight, thereby providing a substantially stable center of gravity throughout the game. The golf bag comprises a golf club chamber which is of a generally elongated rectangular configuration but which has a golf club divider at the top thereof which divides and separates the golf clubs into a plurality of discrete golf club holding sections. Each such section may be considered as having two discrete portions, one on each side of the centerline of the golf club bag, each such portion being different in size and shape from the other. Each such section comprises a large portion and a small portion. The large portion is designed to accommodate more golf clubs than the small portion. The walls of the divider are shaped so that the small portion of each section tends to resist the migration of additional golf clubs toward that small portion, even when the bag is tilted.

6 Claims, 4 Drawing Sheets

GOLF CLUB BAG WITH CLUB DIVIDER

BACKGROUND OF THE INVENT ION

1. Field of the Invention

The present invention relates generally to the field of golf club bags and more specifically to an improved golf club bag having a unique cross-sectional shape and a unique golf club dividing member serving as the top thereof for providing a better balance of clubs in the bag and for assuring proper side-to-side distribution of the clubs.

2. Prior Art

The following U.S. Patents have been determined to be relevant to the present invention:

Calkins U.S. Pat. No. 2,114,870
Venmore U.S. Pat. No. 2,128,546
Vine U.S. Pat. No. 2,607,382
Kouke U.S. Pat. No. 2,781,027
Rader U.S. Pat. No. 4,332,283
Isabel U.S. Pat. No. 4,340,102
Gerber U.S. Pat. No. 4,779,725
Reimers U.S. Pat. No. 4,844,253
Stansbury U.S. Pat. No. 5,071,147
Yonnetti U.S. Pat. No. 5,094,345
Hickin U.S. Pat. No. 5,102,529
Antonious U.S. Pat. No. 5,103,974
Graziano Jr. U.S. Pat. No. 5,125,507

Of the foregoing patents, the following appear to be the most relevant:

U.S. Pat. No. 4,340,102 to Isabel is directed to a golf club bag with apertures to accommodate a set of inverted golf clubs that enables a proper and convenient balance and weight distribution to be achieved and maintained. The bag has a head, a one-piece molding with apertures to accommodate four woods, an elongated aperture with recesses for seven irons, circular apertures for wedges, circular aperture for a putter, and optional apertures for spare clubs, balls, or other items. These apertures and recesses retain the heads of the clubs so that balance and distribution are not disturbed under normal conditions.

U.S. Pat. No. 4,844,253 to Reimers is directed to a lightweight rigid golf bag with a plurality of webbings so the balance point and orientation of the bag while being carried can be adjusted. The bag also can be used with any type of golf cart. The bag has a rigid collar at the open end. The collar has a peripheral flange and cross members that form apertures for placing clubs in the bag in a separated fashion. The collar is angled to a peak so that the golfer may place the clubs in an orderly and separated fashion with some apertures for the longer clubs and others for the shorter clubs. The straps, support bands, and webbing are mounted high on the golf bag since most of the weight of the clubs are in the heads, so as to maintain proper balance.

U.S. Pat. No. 5,125,507 to Graziano Jr. is directed to a golf bag that has a molded mouth with an opening for placing each club in an ordered arrangement by the length of the shafts for a readily visible array that provides quick and easy selection of a club. The bag has a molded mouth of a blunt-nosed triangular shape with the club identifiers molded into the material. The mouth provides for two rows of irons with the longer woods interposed between the rows toward the base. The golf bag has a base or bottom portion and a pair of interior separator webs extending between the mouth and the bottom to maintain the club handles in lateral alignment.

U.S. Pat. No. 5,103,974 to Antonious is directed to several embodiments of a top divider golf club insert to be secured in the opening of the golf bag, as original equipment or as a replacement, providing a primary compartment that is adjustably movable relative to the other compartments for separating and protecting the clubs. The insert includes a plurality of compartments including a primary central compartment and radially disposed compartments formed by dividers. The primary compartment is formed by telescoping cylindrical tubes latched in position by a pin and notches. The central compartment can be adjusted to accommodate various sized clubs.

U.S. Pat. No. 4,332,283 to Rader is directed to a golf bag assembly for supporting and protecting a plurality of golf clubs and keeping them from bunching up and damaging each other. The golf bag includes a conventional cylindrical bag body with an upper end closed by a supporting and protective plate. The plate with a stepped cross-section configuration defines a plurality of plate portions and at different levels for clubs of various lengths. The plate member includes a plurality of club receiving apertures spaced laterally at a selected distance. Each aperture has a boss portion for frictional engagement with elongate golf club protective tubes. Clubs placed in this bag will be positioned and retained separate.

From the foregoing, it can be seen that there have been attempts in the prior art to design golf bags so that the clubs contained therein are distributed in a balanced manner to provide a stable center of gravity to minimize the difficulty in carrying the golf bag. Unfortunately, all such attempts appear to either require the golfer to always replace a golf club in precisely the proper receptacle in the bag or be too expensive to fabricate, requiring complex structures in order to facilitate such proper balancing and distribution of the clubs. Furthermore, some of the aforementioned prior art requires that golf clubs be of a particular shape or have a particularly shaped head in order to match curved, elongate apertures specifically designed to accommodate such shapes. Thus, golf bags of this nature are not sufficiently flexible to accommodate golf clubs of other shapes, such as a golf club putter with an unusually shaped putter head. Thus, there is still an ongoing need for a golf club bag which is adapted for receiving golf clubs in a manner which balances the distribution of the golf clubs to provide a stable center of gravity for the bag user, but without requiring expensive, complex golf club bag structures and without requiring the user to have a precisely shaped receptacle and location for each golf club which can be an inconvenience during a game of golf.

SUMMARY OF THE INVENTION

The present invention comprises an improved golf club bag with a uniquely shaped divider top that is adapted to receive golf clubs in a manner which properly distributes the golf clubs within the bag to balance the distribution of the weight, thereby providing a substantially stable center of gravity throughout the game. However, the present invention accomplishes the proper distribution of golf club weight without requiring expensive and complex structures for the golf bag top and without requiring the user or golfer to always place the golf club in a particular aperture or slot, precisely designated for that particular club and thus avoids the inconvenience of some of the aforementioned prior art. More specifically, the golf bag of the present invention comprises a golf club chamber which is of a generally elongated rectangular configuration but which culminates in a golf club divider at the top thereof which divides and separates the golf clubs into a plurality of discrete golf club holding sections. Each such section may be considered as having two discrete portions, one on each side of the centerline of the golf club bag, each such portion being different in size and shape from the other. Each such section comprises a large portion and a small portion. The large portion is designed to accommodate more golf clubs than the small portion. In the preferred embodiment disclosed herein, the large portions are each designed to accommodate at least two golf clubs and the small portions are designed to accommodate only one golf club. Furthermore, because the respective portions of each section are not physically separated from one another, an additional golf club may be placed in a section in a manner which overlaps both the small portion and the large portion thereof and thus may be considered to be intersected by the centerline of the golf club bag. The walls of the divider are shaped so that the small portion of each section tends to resist the migration of the golf clubs toward that the small portion, even when the bag is tilted. In the preferred embodiment herein disclosed, the small portions of the respective sections are on alternating sides of the centerline of the golf club bag so that the golf clubs in each section tend to be balanced when combined with the golf clubs in an adjacent section. Thus, in the preferred embodiment herein, there are four golf club holding sections in the top divider of the bag. The first and third sections have their smaller portions on one side of the centerline of the bag, while the second and fourth section have their small portions on the opposite side of the centerline of the bag. By alternating the relative locations of the small and large portions in each section, the overall distribution of clubs within a bag tends to be balanced relative to the centerline of the golf bag. However, unlike the prior art, this is accomplished in the present invention using a simple structure that is inexpensively fabricated and which is convenient to the golfer by not requiring that any individual club be installed within a particular section of the golf bag. Another feature of the invention resides in a uniquely configured and positioned strap extension which tends to prevent the golf bag from tipping due to the weight of the golf club heads and the light weight of the bag while the bag is being carried. The strap extension protrudes above the top of the bag to keep the bag in a more vertical orientation with a strap-over-the-shoulder carrying configuration.

OBJECTS OF THE INVENTION

It is therefore a principal object of the present invention to provide an improved golf bag, the top of which is divided into a plurality of sections specifically designed to produce a balanced distribution of golf clubs contained in the bag, relative to the centerline of the bag, whereby the bag exhibits a relatively stable center of gravity location substantially independent of the use and replacement of the golf clubs during the game.

It is an additional object of the present invention to provide an improved golf club bag having a structure designed to promote the balanced distribution of golf clubs contained therein but without requiring complex and costly structures and without requiring the golfer to always replace a golf club in a selected position within the bag.

It is still an additional object of the present invention to provide an improved golf club bag having a unique golf strap extension which prevents undue tipping of the bag while it is being carried in a conventional over-the-shoulder strap configuration.

It is still an additional object of the present invention to provide an improved golf club bag made of lightweight materials and configured for a more even distribution and balancing of the golf clubs contained therein to facilitate more convenient transport of the bag during the game of golf.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
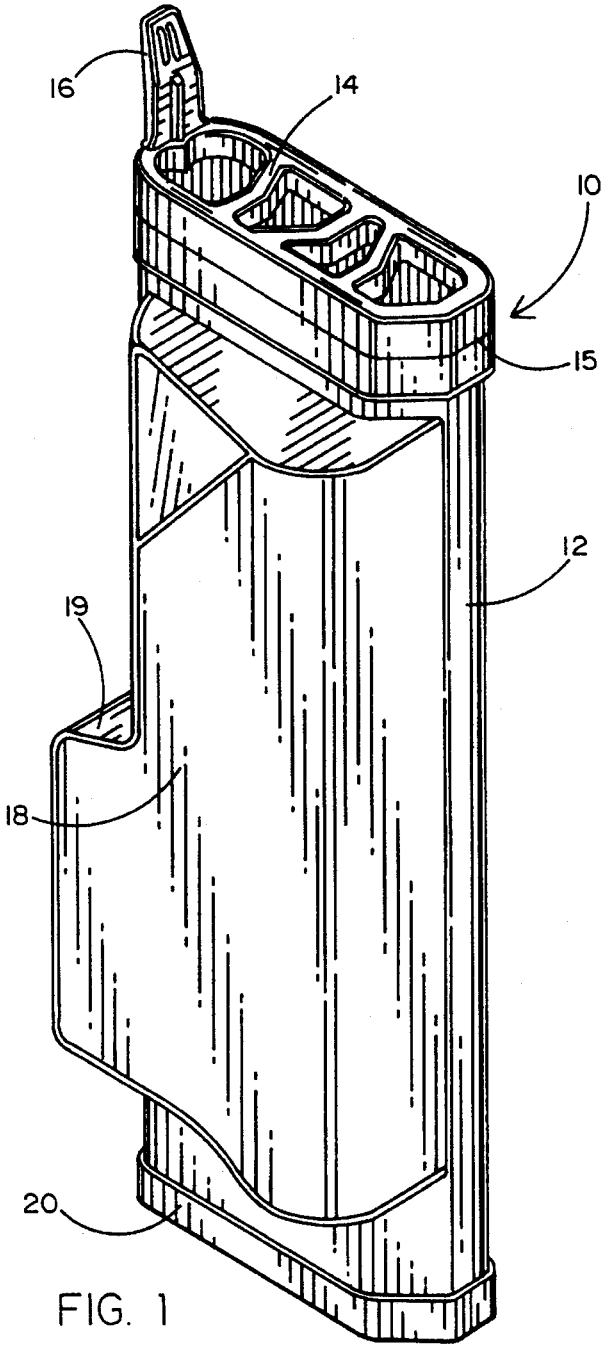
FIG. 1 is an isometric view of the present invention.
Figure 2:
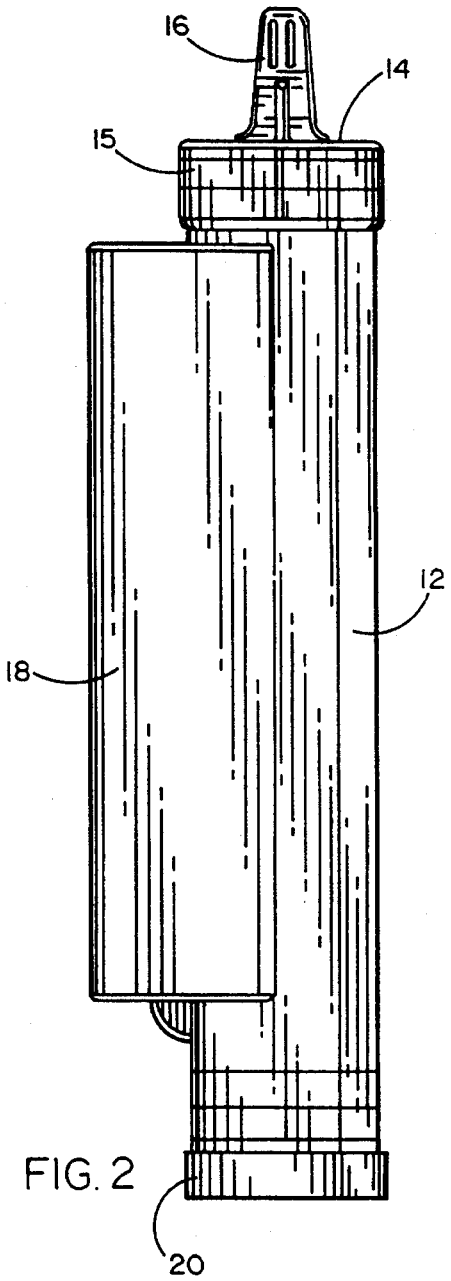
FIG. 2 is a front view of the present invention.
Figure 5:
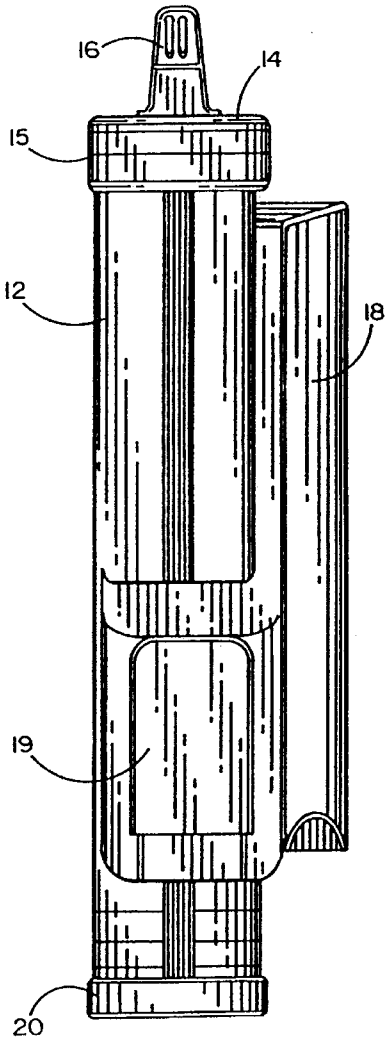
FIG. 5 is a rear view of the present invention.
Figure 4:
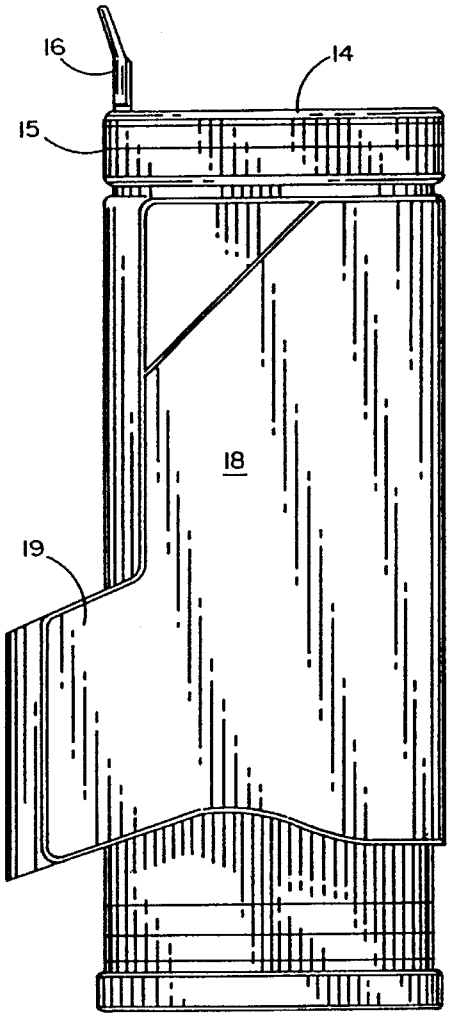
FIG. 4 is a right side view of the present invention.
Figure 3:
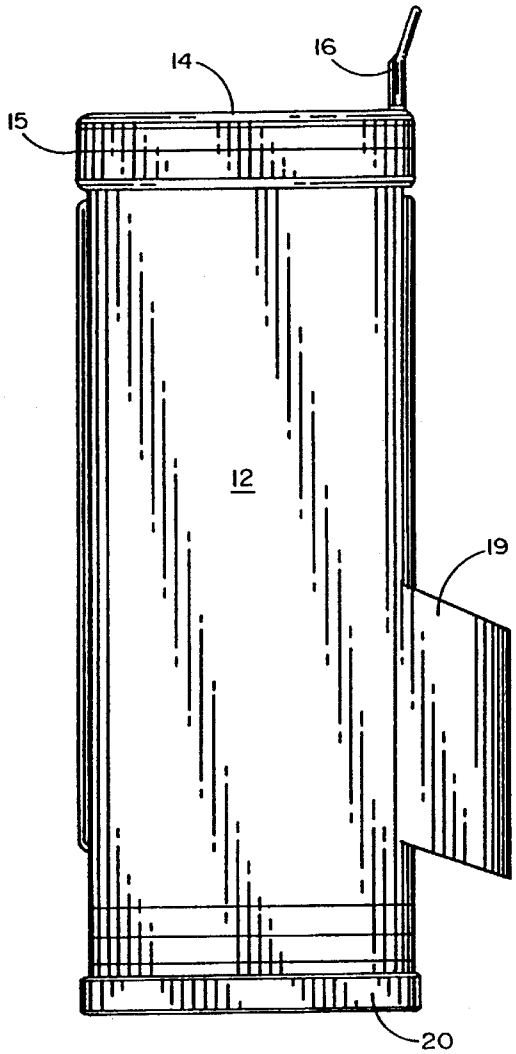
FIG. 3 is a left side view of the present invention.
Figure 7:
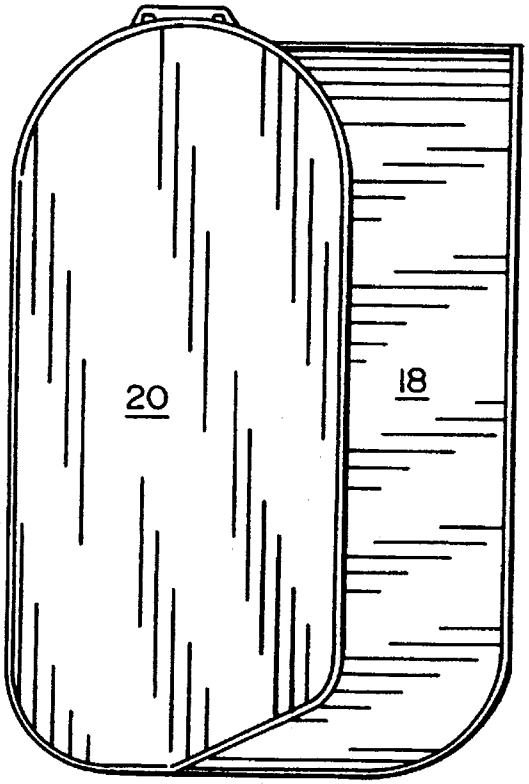
FIG. 7 is a bottom view of the present invention.
Figure 6:
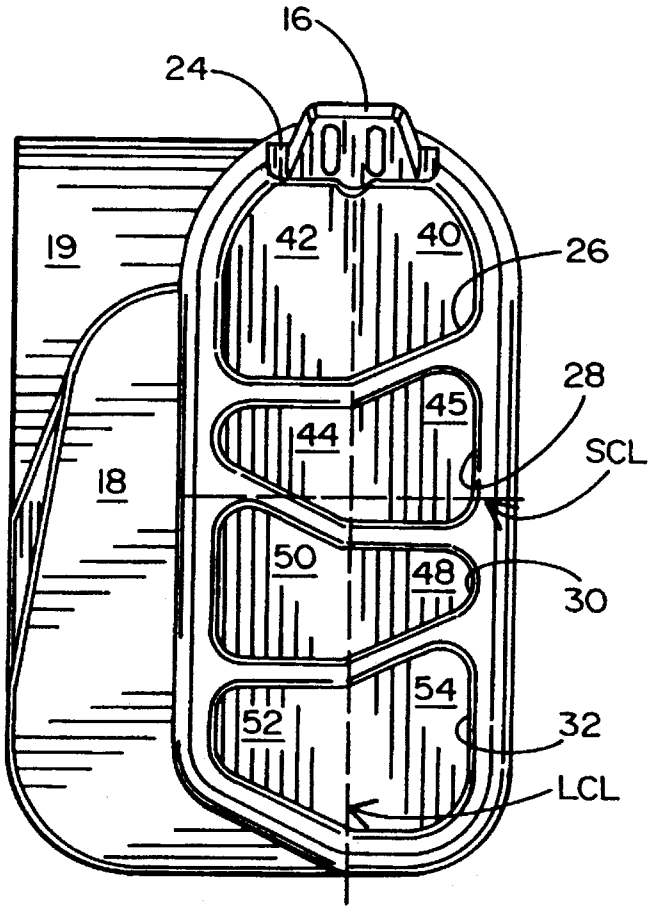
FIG. 6 is a top view of the present invention.

Referring now to the accompanying drawings, it will be seen that the improved golf bag 10 of the present invention comprises a golf club enclosure 12, the interior of which forms a chamber for receiving a plurality of golf clubs (not shown). Golf club enclosure 12 is generally open at the top 15 but partially enclosed by a golf club divider 14, the details of which will be discussed hereinafter primarily in conjunction with FIG. 6. The bottom of enclosure 12 is completely sealed by a bag bottom 20. In addition, one side of the enclosure 12 is integrally connected to a storage compartment 18, preferably sufficiently large to permit the storage of golf shoes and the like and being divided from a separate ball and tee holder compartment 19, seen best in FIG. 5. Referring now to FIG. 6, it will be seen that golf club divider 14 is segregated into a plurality of sections. In the preferred embodiment shown herein, there are four such sections, namely sections 26, 28, 30 and 32. Furthermore, it will be seen that each such section is divided into two distinct portions, such portions being on opposite sides of the long centerline $LC_L$ of the golf club bag. Thus for example, section 26 provides a smaller portion 40 and a larger portion 42. Section 28 provides a smaller portion 44 and a larger portion 46. Section 30 provides a smaller portion 48 and a larger portion 50 and section 32 provides a smaller portion 52 and a larger portion 54. Sections 26 and 28 reside primarily on one side of a short centerline $SC_L$, while sections 30 and 32 reside on the opposite side of short centerline $SC_L$.

The size and shape of each such smaller portion of each such section in the preferred embodiment illustrated in FIG. 6, are selected so that there is adequate area for the handle or grip portion of one golf club to occupy that smaller portion. On the other hand, the larger portions of each such section are shaped and sized to accept at least two or more grip portions of golf clubs. Thus, irrespective of which of the sections of the golf club divider a golf club is placed, that section is likely to have at least one additional golf club positioned in its larger portion than in its smaller portion. This feature, combined with the feature of having the larger portions of adjacent sections being on alternate sides of the centerline of the golf club bag, tends to distribute the golf clubs so that an equal number is on each side of the centerline $LC_L$. Furthermore, because each section can only accept three or four golf clubs of the usual 12 to 14 total clubs carried by a golfer, every section, 26, 28, 30 and 32 would normally have some number of golf clubs contained therein, thereby avoiding any radical unbalancing effect that might otherwise occur if a majority of golf clubs were contained in any one of the sections of the divider 14. Thus, it will be seen that the divider 14, by means of the number of independent, separated sections contained therein and the respective shapes of the sections, as well as the respective large and small portions in each such section, creates a unique golf club distribution. This distribution tends to balance the club weight within the golf bag 10 so that the center of gravity resides in a relatively stable position proximate the actual vertical centerline of the bag 10.

Figure 8:
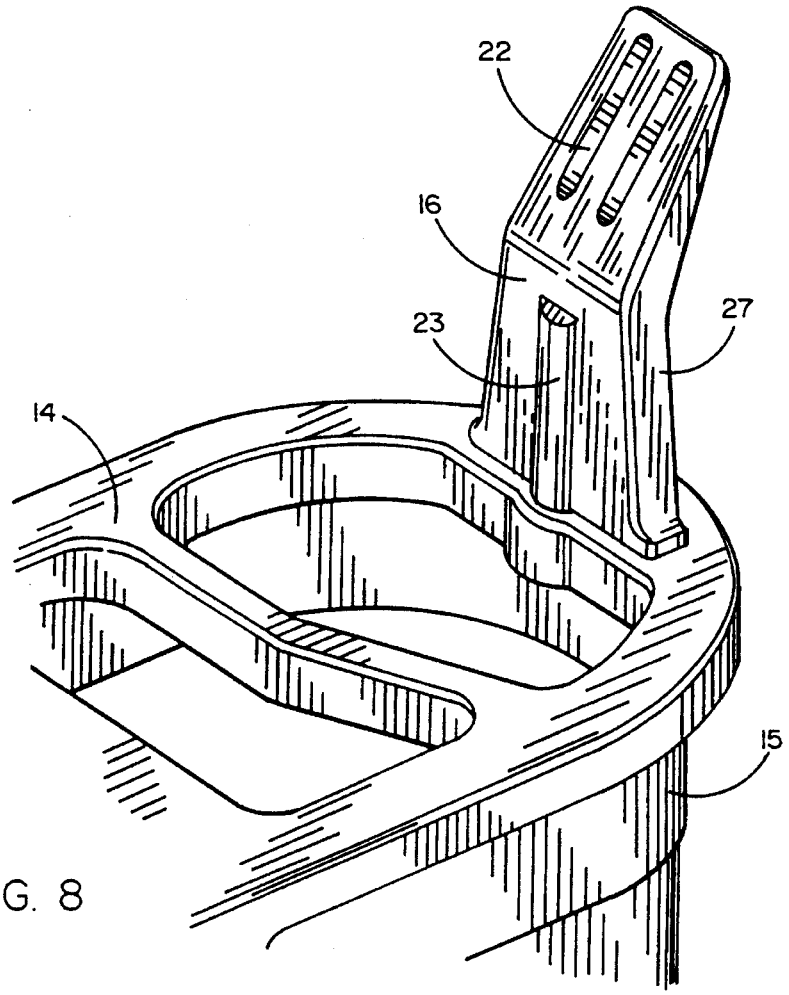
FIG. 8 is an enlarged isometric view of the strap extension of the present invention shown installed in the top of the bag thereof.
Figure 9:
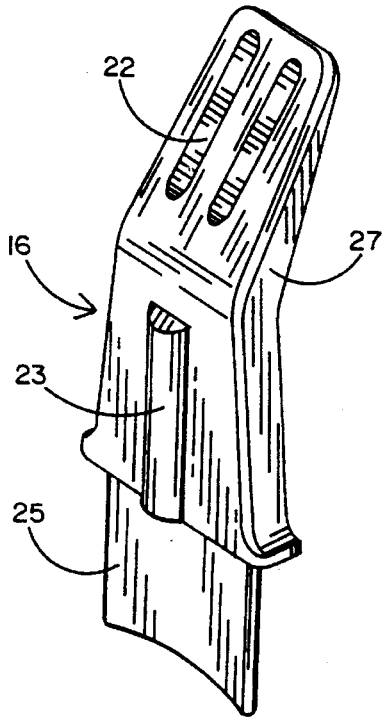
FIG. 9 is an enlarged isometric view of the strap extension portion of the present invention shown separate from the bag.

Referring now to FIGS. 8 and 9, it will be seen that strap extension 16 comprises a bent body 27, the lower portion of which is integral to a curved extension tongue 25 which is shaped to be press fit into an extension slot 24 in the divider 14. The lower portion of body 27 provides a rib 23 which forms a stop against divider 14. The upper portion of body 27 provides a pair of elongated strap eyes 22 for receiving a shoulder strap (not shown). The height of the body 27 above the divider and particularly, the height of eyes 22, reduces the likelihood of the bag 10 tilting due to the weight of the club heads, thus countering the high center of gravity due to use of a lightweight bag and clubs having a majority of their respective weight at the heads thereof.

Having thus disclosed a preferred embodiment of the golf bag of the present invention, what is claimed is:

1. An improved golf bag comprising:

an elongated substantially rectangular housing defined by short and long centerlines and forming an enclosure for receiving a plurality of golf clubs, the enclosure having an open mouth at one end; and a golf club divider positioned in said open mouth for receiving said golf clubs in a plurality of segregated sections, each said section having shaped walls forming a large portion and a small portion, said large and small portions being disposed substantially on opposite sides of said long centerline, the small portions of adjacent sections being on opposite sides of said long centerline and the number of sections on each side of said short centerline being about equal;

wherein each said large portion of each said section is designed to receive at least two golf clubs.

2. The golf bag recited in claim 1 wherein each said small portion of each said section is designed to receive only one golf club.

3. The golf bag recited in claim 1 further comprising a golf strap extension attached to said divider and extending therefrom above said enclosure.

4. An improved golf bag comprising:

an elongated substantially rectangular housing defined by short and long centerlines and forming an enclosure for receiving a plurality of golf clubs, the enclosure having an open mouth at one end; and a golf club divider positioned in said open mouth for receiving said golf clubs in a plurality of segregated sections, each said section having shaped walls forming a large portion and a small portion, said large and small portions being disposed substantially on opposite sides of said long centerline, the small portions of adjacent sections being on opposite sides of said long centerline and the number of sections on each side of said short centerline being about equal;

wherein there are four said sections comprising two end sections and two intermediate sections and wherein said end sections are larger than said intermediate sections.

5. An improved golf bag comprising:

an elongated substantially rectangular housing defined by short and long centerlines and forming an enclosure for receiving a plurality of golf clubs, the enclosure having an open mouth at one end; and a golf club divider positioned in said open mouth for receiving said golf clubs in a plurality of segregated sections, each said section having shaped walls forming a large portion and a small portion, said large and small portions being disposed substantially on opposite sides of said long centerline, the small portions of adjacent sections being on opposite sides of said long centerline and the number of sections on each side of said short centerline being about equal;

wherein each large portion of each said section is designed to receive at least one more golf club than the corresponding small portion of each such section.

6. An improved golf bag comprising:

an elongated substantially rectangular housing defined by short and long centerlines and forming an enclosure for receiving a plurality of golf clubs, the enclosure having an open mouth at one end; and a golf club divider positioned in said open mouth for receiving said golf clubs in a plurality of segregated sections, each said section having shaped walls forming a large portion and a small portion, said large and small portions being disposed substantially on opposite sides of said long centerline, the small portions of adjacent sections being on opposite sides of said long centerline and the number of sections on each side of said short centerline being about equal;

wherein the length of said divider along said long centerline is at least double the length of said divider along said short centerline.

* * * * *